US010344580B2

(12) United States Patent
Williams

(10) Patent No.: US 10,344,580 B2
(45) Date of Patent: Jul. 9, 2019

(54) PASSIVE MULTIPHASE FLOW SEPARATOR

(71) Applicant: GE Oil & Gas ESP, Inc., Oklahoma City, OK (US)

(72) Inventor: Jason Ryan Williams, Houston, TX (US)

(73) Assignee: GE Oil & Gas ESP, Inc., Oklahoma City, OK (US)

( * ) Notice: Subject to any disclaimer, the term of this patent is extended or adjusted under 35 U.S.C. 154(b) by 6 days.

(21) Appl. No.: 15/586,086

(22) Filed: May 3, 2017

(65) Prior Publication Data

US 2018/0320500 A1 Nov. 8, 2018

(51) Int. Cl.
*E21B 43/38* (2006.01)
*E21B 43/12* (2006.01)

(52) U.S. Cl.
CPC ..... *E21B 43/38* (2013.01); *E21B 43/128* (2013.01)

(58) Field of Classification Search
CPC ..... E21B 43/40; E21B 43/38; E21B 43/128
See application file for complete search history.

(56) References Cited

U.S. PATENT DOCUMENTS 3,734,140 A * 5/1973 Nakamura ..... B21C 37/207 138/177
4,832,709 A 5/1989 Nagyszalanczy
4,834,887 A 5/1989 Broughton
4,900,433 A * 2/1990 Dean ..... B01D 19/0052 166/105.5
4,981,175 A 1/1991 Powers
5,207,810 A 5/1993 Sheth
5,209,765 A 5/1993 Kolpak et al.
5,902,378 A 5/1999 Obrejanu
6,066,193 A 5/2000 Lee
6,394,182 B1 5/2002 Fadel
6,705,402 B2 3/2004 Proctor
6,761,215 B2 7/2004 Morrison
6,860,921 B2 3/2005 Cooper
7,343,967 B1 3/2008 Floyd
7,357,186 B1 4/2008 Berry
(Continued)

OTHER PUBLICATIONS

Javier Ibarra, et al., Effect of Viscosity and pressure on a poor boy downhole gas separator under continuous gas-liquid flow, 2014, Heavy Oil, Latin America Conference & Exhibition; Venezuela 2014.

(Continued)

*Primary Examiner* — Kenneth L Thompson
(74) *Attorney, Agent, or Firm* — Crowe & Dunlevy, P.C.

(57) ABSTRACT

A passive multiphase separator is configured to separate gas from a two-phase fluid in a wellbore. The passive multiphase separator includes an intake tube that has an intake end, a discharge end and an interior section between the intake end and the discharge end. The interior section includes a rifled interior surface that induces rotation in fluids passing through the interior section. The passive multiphase separator further includes a head assembly connected to the discharge end of the intake tube. The head assembly includes a crossover tube extending into the interior section, one or more gas vents extending from an interior of the crossover tube to an exterior of the head assembly and a liquid discharge. The passive multiphase separator can be deployed in a variety of hydrocarbon recovery systems.

20 Claims, 8 Drawing Sheets

(56) References Cited

U.S. PATENT DOCUMENTS

| | | | | |
|---|---|---|---|---|
| 7,377,313 | B2 | 5/2008 | Brown et al. | |
| 7,461,692 | B1 | 12/2008 | Wang | |
| 7,462,225 | B1 | 12/2008 | Ketter et al. | |
| 7,883,570 | B2 | 2/2011 | Obrejanu | |
| 9,249,653 | B1 | 2/2016 | Botts | |
| 9,283,497 | B2 | 3/2016 | Wang et al. | |
| 2003/0111230 | A1 | 6/2003 | Olson et al. | |
| 2004/0238179 | A1* | 12/2004 | Murray | E21B 43/38 166/369 |
| 2006/0175062 | A1* | 8/2006 | Benson | E21B 17/01 166/335 |
| 2007/0235196 | A1 | 10/2007 | Brown et al. | |
| 2010/0175869 | A1 | 7/2010 | Cobb | |
| 2014/0138306 | A1 | 5/2014 | Wu et al. | |
| 2014/0216720 | A1 | 8/2014 | Wang et al. | |
| 2017/0074083 | A1 | 3/2017 | Morton, III et al. | |
| 2018/0306019 | A1* | 10/2018 | Saponja | B01D 19/00 |

OTHER PUBLICATIONS

Lixin Zhao, et al., Centrifugal Separators Used for Oilfield Multi-Phase Separation; 2008; ASME 2008 27th International Conference on Offshore Mechanics and Arctic Engineering (Abstract).

G.D. Zarnett, et al., Cocurrent gas-liquid flow in horizontal tubes with internal spiral ribs; 1969; The Canadian Journal of Chemical Engineering (Abstract).

International Search Report and Written Opinion issued in connection with corresponding PCT Application No. PCT/US2018/028982 dated Aug. 9, 2018.

* cited by examiner

PASSIVE MULTIPHASE FLOW SEPARATOR

FIELD OF THE INVENTION

This invention relates generally to the field of oil and gas production, and more particularly to downhole gas separation systems for improving the recovery of oil and gas from a well.

BACKGROUND

Hydrocarbon fluids produced from subterranean wells often include liquids and gases. Although both may be valuable, the multiphase flow may complicate recovery efforts. For example, naturally producing wells with elevated gas fractions may overload phase separators located on the surface. This may cause gas to be entrained in fluid product lines, which can adversely affect downstream storage and processing.

In wells in which artificial lift solutions have been deployed, excess amounts of gas in the wellbore fluid can present problems for downhole equipment that is primarily designed to produce liquid-phase products. For example, the centrifugal forces exerted by downhole turbomachinery tend to separate gas from liquid, thereby increasing the chances of cavitation or vapor lock. Downhole gas separators have been used to remove gas before the wellbore fluids enter the pump. In operation, wellbore fluid is drawn into the gas separator through an intake. A lift generator provides additional lift to move the wellbore fluid into an agitator. The agitator is typically configured as a rotary paddle that imparts centrifugal force to the wellbore fluid. As the wellbore fluid passes through the agitator, heavier components, such as oil and water, are carried to the outer edge of the agitator blade, while lighter components, such as gas, remain close to the center of the agitator. In this way, modern gas separators take advantage of the relative difference in specific gravities between the various components of the two-phase wellbore fluid to separate gas from liquid. Once separated, the liquid can be directed to the pump assembly and the gas vented from the gas separator.

Although generally effective, these prior art gas downhole gas separators incorporate the use of a driven shaft that may not be present in all certain applications. Accordingly, there is a need for an improved gas separator system that provides gas separation functionality over an extended range of applications.

SUMMARY OF THE INVENTION

In one aspect, the present invention includes a passive multiphase separator configured to separate gas from a two-phase fluid in a wellbore. The passive multiphase separator includes an intake tube that has an intake end, a discharge end and an interior section between the intake end and the discharge end. The interior section includes a rifled interior surface. The passive multiphase separator further includes a head assembly connected to the discharge end of the intake tube. The head assembly includes a crossover tube extending into the interior section, one or more gas vents extending from an interior of the crossover tube to an exterior of the head assembly and a liquid discharge.

In another aspect, the present invention includes a hydrocarbon recovery system for use in conveying multiphase hydrocarbons from a wellbore to a wellhead. The hydrocarbon recovery system includes production tubing that is connected to the wellhead and extends into the wellbore.

The hydrocarbon recovery system further includes a passive multiphase separator connected to the production tubing. The passive multiphase separator includes an intake tube that has an intake end, a discharge end and an interior section between the intake end and the discharge end. The interior section includes a rifled interior surface. The passive multiphase separator further includes a head assembly connected to the discharge end of the intake tube. The head assembly includes a crossover tube extending into the interior section, one or more gas vents extending from an interior of the crossover tube to an exterior of the head assembly and a liquid discharge.

In yet another aspect, the present invention includes a hydrocarbon recovery system for use in conveying multiphase hydrocarbons from a wellbore to a wellhead. The hydrocarbon recovery system includes production tubing connected to the wellhead and extending into the wellbore and a passive multiphase separator. The passive multiphase separator is deployed through the production tubing and retained within the production tubing. The passive multiphase separator includes an intake tube that has an intake end, a discharge end and an interior section between the intake end and the discharge end. The interior section includes a rifled interior surface. The passive multiphase separator further includes a head assembly connected to the discharge end of the intake tube. The head assembly includes a crossover tube extending into the interior section, one or more gas vents connected to the crossover tube and a liquid discharge in fluid communication with an interior of the production tubing.

WRITTEN DESCRIPTION

As used herein, the term "petroleum" refers broadly to all mineral hydrocarbons, such as crude oil, gas and combinations of oil and gas. The term "two-phase" or "multiphase" refers to a fluid that includes a mixture of gases and liquids. It will be appreciated by those of skill in the art that in the downhole environment, such fluids may also carry solids and suspensions. Accordingly, as used herein, the terms "two-phase" and "multiphase" are not exclusive of fluids that may also contain liquids, gases, solids, or other intermediary forms of matter.

Figure 1:
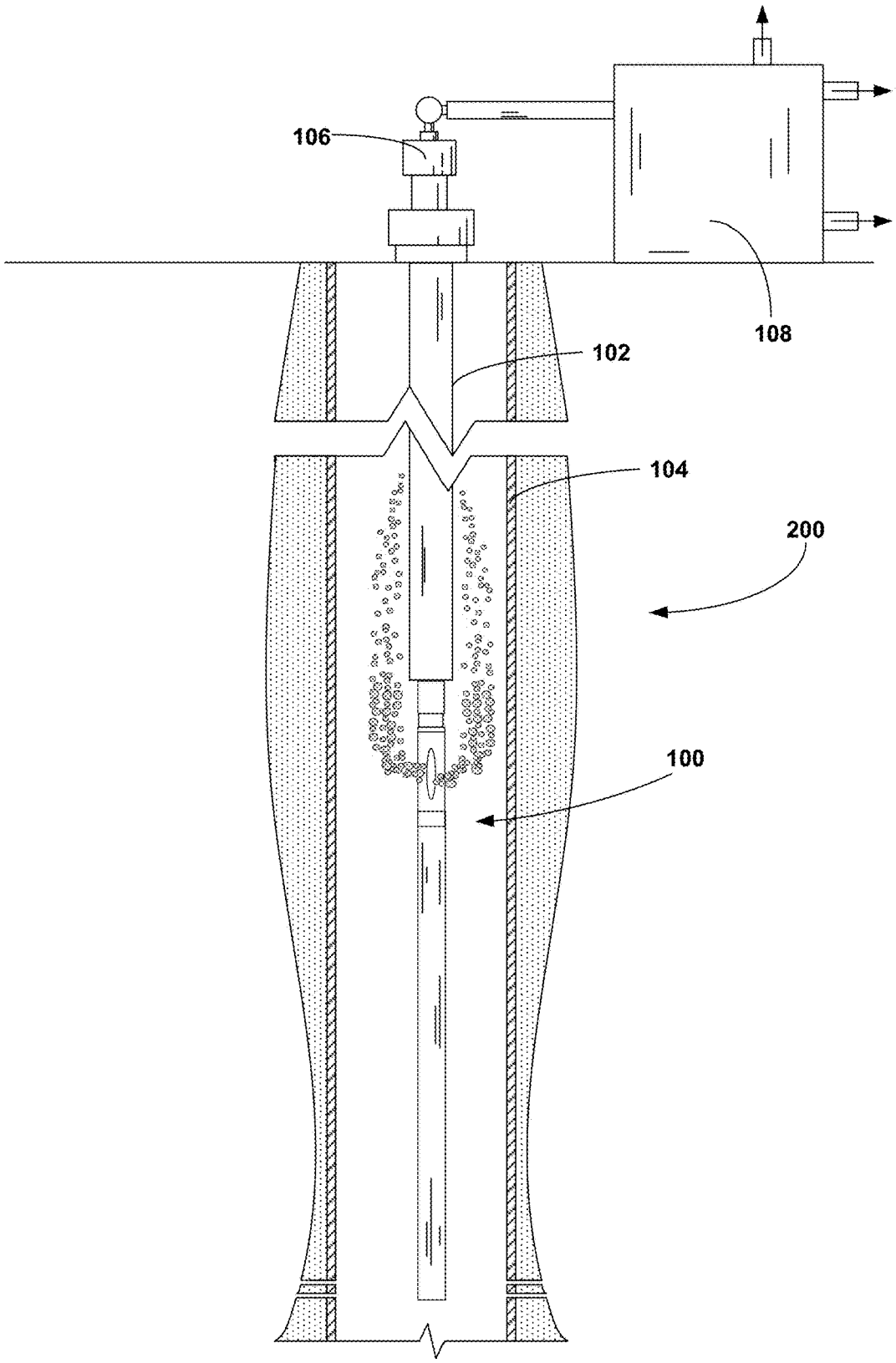
FIG. 1 depicts a passive multiphase separator incorporated within a naturally producing well.

FIG. 1 shows an elevational view of a passive multiphase separator 100 connected to production tubing 102. The passive multiphase separator 100 and production tubing 102 are disposed in a wellbore 104, which is drilled for the production of a fluid such as water or petroleum. The production tubing 102 connects the passive multiphase separator 100 to a wellhead 106 located on the surface. A surface separator 108 is connected to the wellhead 106 and separates the produced fluids into multiple product streams based primarily on the relative densities of the various constituent components of the produced fluids. As used in this disclosure, the term "production tubing" will refer to both rigid straight-walled tubing and flexible coiled tubing. "Hydrocarbon recover system 200" generally refers to the use of the passive multiphase separator 100 in combination with other components to assist or improve the recovery of hydrocarbons from the wellbore 104. In the embodiment depicted in FIG. 1, the hydrocarbon recovery system 200 includes the passive multiphase separator 100 and the production tubing 102.

For the purposes of the disclosure herein, the terms "upstream" and "downstream" are used to refer to the relative positions of components or portions of components with respect to the general flow of fluids produced from the wellbore 104. "Upstream" refers to a position or component that is passed earlier than a "downstream" position or component as fluid is produced from the wellbore 104. The terms "upstream" and "downstream" are not necessarily dependent on the relative vertical orientation of a component or position. It will be appreciated that many of the components in the hydrocarbon recovery system 200 are substantially cylindrical and have a common longitudinal axis that extends through the center of the elongated cylinder and a radius extending from the longitudinal axis to an outer circumference. Objects and motion may be described in terms of radial positions within discrete components in the hydrocarbon recovery system 200.

As shown in FIG. 1, fluids are produced from the wellbore 104 under naturally-occurring pressure without an artificial lift system during a primary recovery phase. Fluids enter the wellbore 104 from the surrounding formation under sufficient pressure to push the fluids through the passive multiphase separator and production tubing 102 to the wellhead 106. As the natural reservoir pressure declines, it may be useful to apply secondary recovery techniques such as water flooding to increase the production of fluids from the wellbore 104.

The passive multiphase separator 100 is configured to remove a portion of gas from the fluid before it moves into the production tubing 102. The gaseous components are ejected into the annulus of the wellbore 104, while the predominantly liquid phase components are pushed to the surface through the production tubing 102. Removing gas in the wellbore 104 alleviates some of the burden placed on the surface separator 108. Notably, the passive multiphase separator 100 does not include moving parts and is not powered by an external power source.

Figure 2:
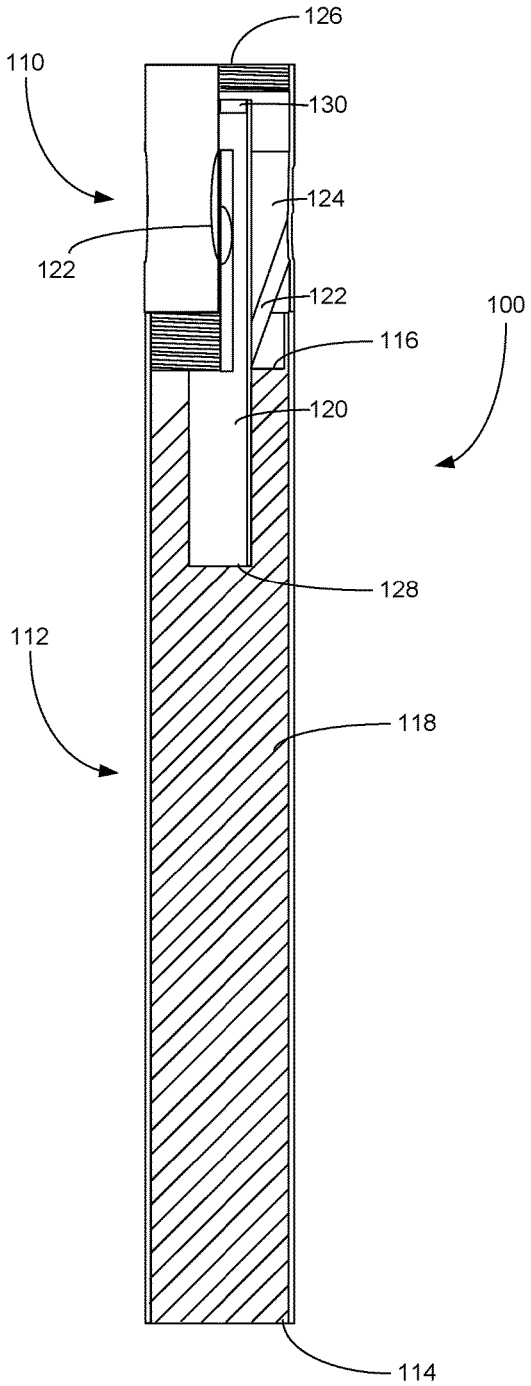
FIG. 2 is a partial cross-sectional view of the passive multiphase separator of FIG. 1.
Figure 3:
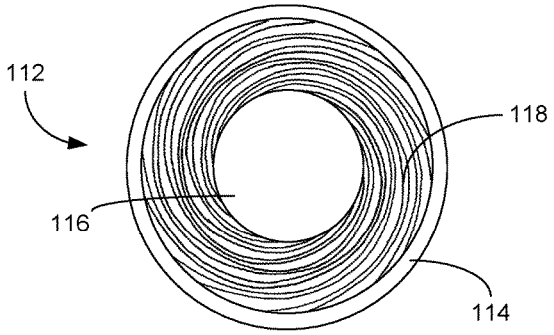
FIG. 3 is an end view of the rifled intake tube of the passive multiphase separator of FIG. 2.

Turning to FIG. 2, shown therein is a partial cross-sectional view of the passive multiphase separator 100. The passive multiphase separator 100 includes a head assembly 110 that is connected to an intake tube 112. The intake tube 112 is an elongated tube with an intake end 114, a discharge end 116 and a rifled interior section 118 between the intake end 114 and discharge end 116. The rifled interior section 118 can be produced with spiraled ribs that project inward from an interior surface, or from spiraled grooves cut into the interior surface. In either case, the rifled interior section 118 induces a rotation in fluids passing from the intake end 114 to the discharge end 116. The length of the intake tube 112 can be determined based on the anticipated composition, pressure and velocities of the wellbore fluids. FIG. 3 provides an end-view of the intake tube 112.

Figure 4:
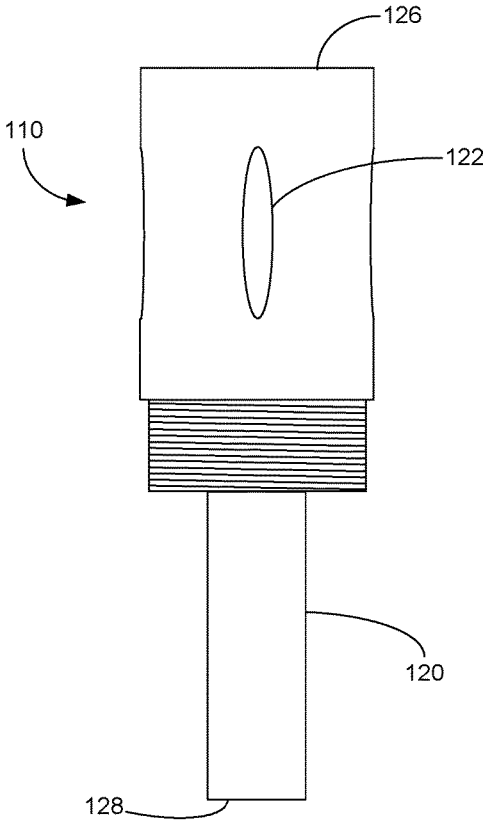
FIG. 4 is a side view of the head assembly of the passive multiphase separator of FIG. 2.

The head assembly 110 is connected to the discharge end of the intake tube 112. As illustrated in FIG. 4, the head assembly 110 can be configured for a threaded engagement with the intake tube 112. The head assembly 110 includes a crossover tube 120, one or more gas vents 122, stabilization fins 124 and a liquid discharge 126. The crossover tube 120 extends into the rifled interior section 118 of the intake tube 112 and is radially centered within the intake tube 112. The crossover tube 120 has an open lower end 128 and capped upper end 130. The gas vents 122 extend from the exterior of the head assembly 110 to the interior of the crossover tube 120. Stabilization fins 124 support the gas vents 122 and center the crossover tube 120 within the head assembly 110. The stabilization fins 124 also reduce the rotation of liquids passing through the head assembly 110.

The rotation imparted to fluids passing through the rifled interior section 118 of the intake tube 112 induces a vortex in which heavier components are carried under centrifugal force outward toward the wall of the intake tube 112. The heavier fluids avoid the crossover tube 120, passing through the annular space between the crossover tube 120 and the intake tube 112, then through the stabilization fins 124 and out the liquid discharge 126 of the head assembly 110. In contrast, lighter, gaseous components moving through the intake tube 112 are displaced by the heavier fluids and are forced inward to the radial center of the of the intake tube 112, where they are picked up by the crossover tube 120. The lighter components are carried through the crossover tube 120 and expelled from the passive multiphase separator 100 through the gas vents 122. As depicted in FIG. 1, the gaseous components are forced through the gas vents 122 into the wellbore 104. The passive multiphase separator 100 provides a simple and efficient mechanism for lowering the gas content of fluids produced from the wellbore 104 without the need for a motorized separation system.

The passive multiphase separator 100 can be installed at end of the production tubing 102 (as shown in FIG. 1) or at a location between the intake to the production tubing 102 and the wellhead 106. In some embodiments, the passive multiphase separator 100 is installed during the initial completion of the well when the production tubing 102 is first deployed in the wellbore 104. In other embodiments, the passive multiphase separator 100 is installed after the production tubing 102 has been deployed by running the passive multiphase separator 100 through the production tubing 102 (as illustrated in FIG. 3) and landing the passive multiphase separator 100 within the production tubing 102 at a location and manner such that expelled gas does not enter the production tubing 102.

Figure 5:
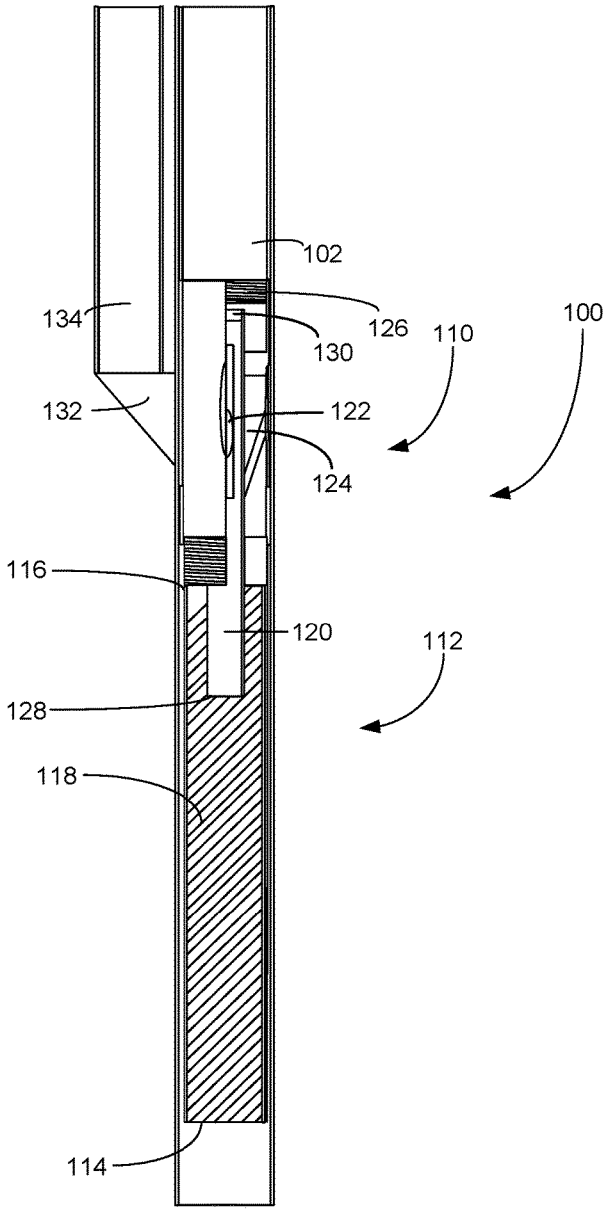
FIG. 5 is a partial cross-sectional view of the passive multiphase separator of FIG. 2 connected to a bypass tool.
Figure 6:
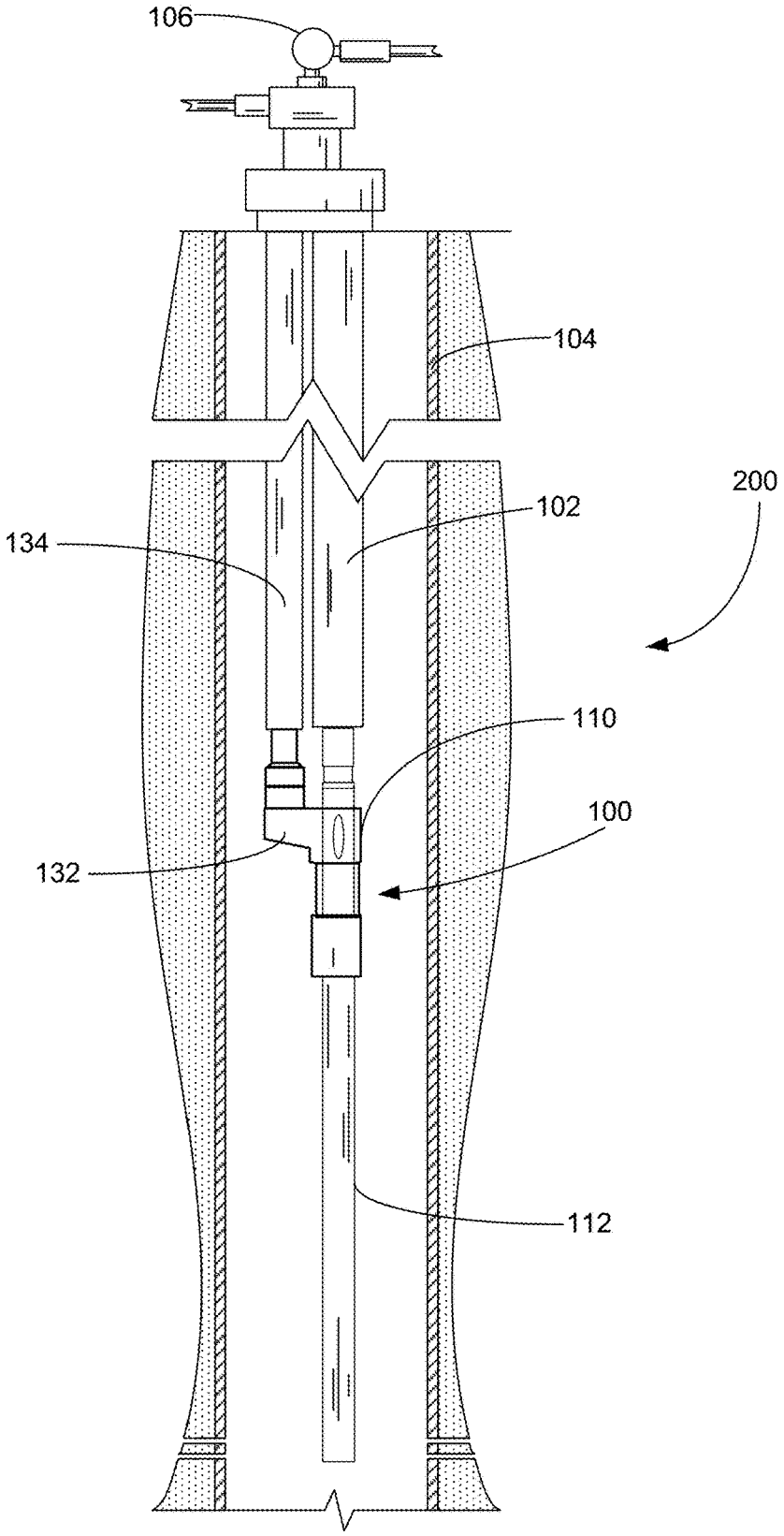
FIG. 6 depicts the use of the passive multiphase separator in a naturally producing well with an inverted Y-tool and gas bypass line.

Turning to FIGS. 5 and 6, shown therein is an alternate application of the passive multiphase separator 100. In this application, the hydrocarbon recovery system 200 includes the passive multiphase separator 100 and an inverted Y-tool 132. The Y-tool 132 is positioned around the outside of the head assembly 110 of the passive multiphase separator 100 such that gas vents 122 expel gas into the Y-tool 132. The Y-tool 132 is connected to a gas bypass line 134 that directs separated gas to the wellhead 106 in a separate conduit from the liquid in the production tubing 102. The gas bypass line 134 can be omitted in some applications such that the Y-tool 132 simply expels the gaseous components into the wellbore 104. As before, liquid components are directed from the passive multiphase separator 100 into the production tubing 102, where they are directed to the wellhead 106 on the surface. The wellhead 106 is configured so that the gas from the gas bypass line 134 and liquid from the production tubing 102 are directed from the wellhead 106 through separate lines to downstream storage, treatment or refining facilities.

Figure 7:
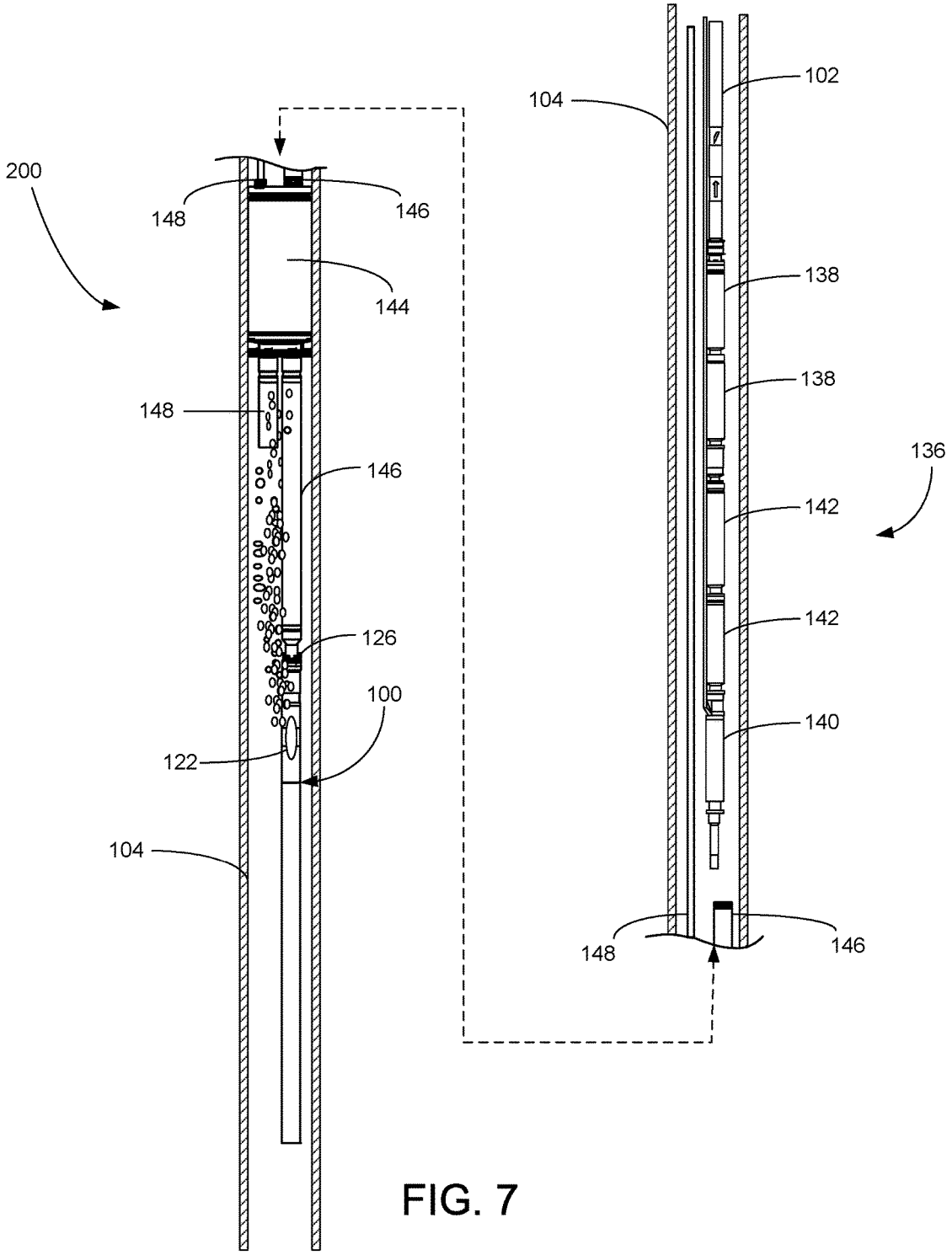
FIG. 7 depicts the use of the passive multiphase separator in connection with an electric submersible pump and single dual packer.

Turning to FIG. 7, shown therein is a depiction of the passive multiphase separator 100 in an additional application. In this application, the hydrocarbon recovery system 200 includes the passive multiphase separator 100 and an electric submersible pumping system 136 that provides artificial lift to force fluids from the wellbore 104. The pumping system 136 includes some combination of a pump 138, a motor 140 and one or more seal sections 142. The seal sections 142 shield the motor assembly 140 from mechanical thrust produced by the pump 138 and provide for the expansion of motor lubricants during operation. When energized by the motor 140, the pump 138 forces fluids from the wellbore 104 through the production tubing 102 to the surface.

The hydrocarbon recovery system 200 further includes a lower packer 144 positioned between the passive multiphase separator 100 and the pumping system 136. The lower packer 144 generally separates the wellbore 104 into isolated zones above and below the lower packer 144. As shown in FIG. 7, the lower packer 144 is configured as a "dual packer" that accommodates two lines that extend through the lower packer 144 that each convey fluids between the zones above and below the lower packer 144.

In particular, the lower packer 144 is connected to the liquid discharge 126 of the passive multiphase separator 100 with a pup joint 146. The pup joint 146 passes directly or indirectly through the lower packer 144 such that fluids moving through the pup joint 146 are contained within the pup joint 146 as they pass through the lower packer 144. In this way, fluids discharged from the liquid discharge 126 of the passive multiphase separator 100 are carried by the pup joint 146 through the lower packer 144 into the wellbore 104 above the lower packer 144. A gas collection line 148 extends from below the lower packer 144 to the surface. Gas that has collected under the lower packer 144 is carried by the gas collection line 148 through the lower packer 144 to the surface.

Figure 8:
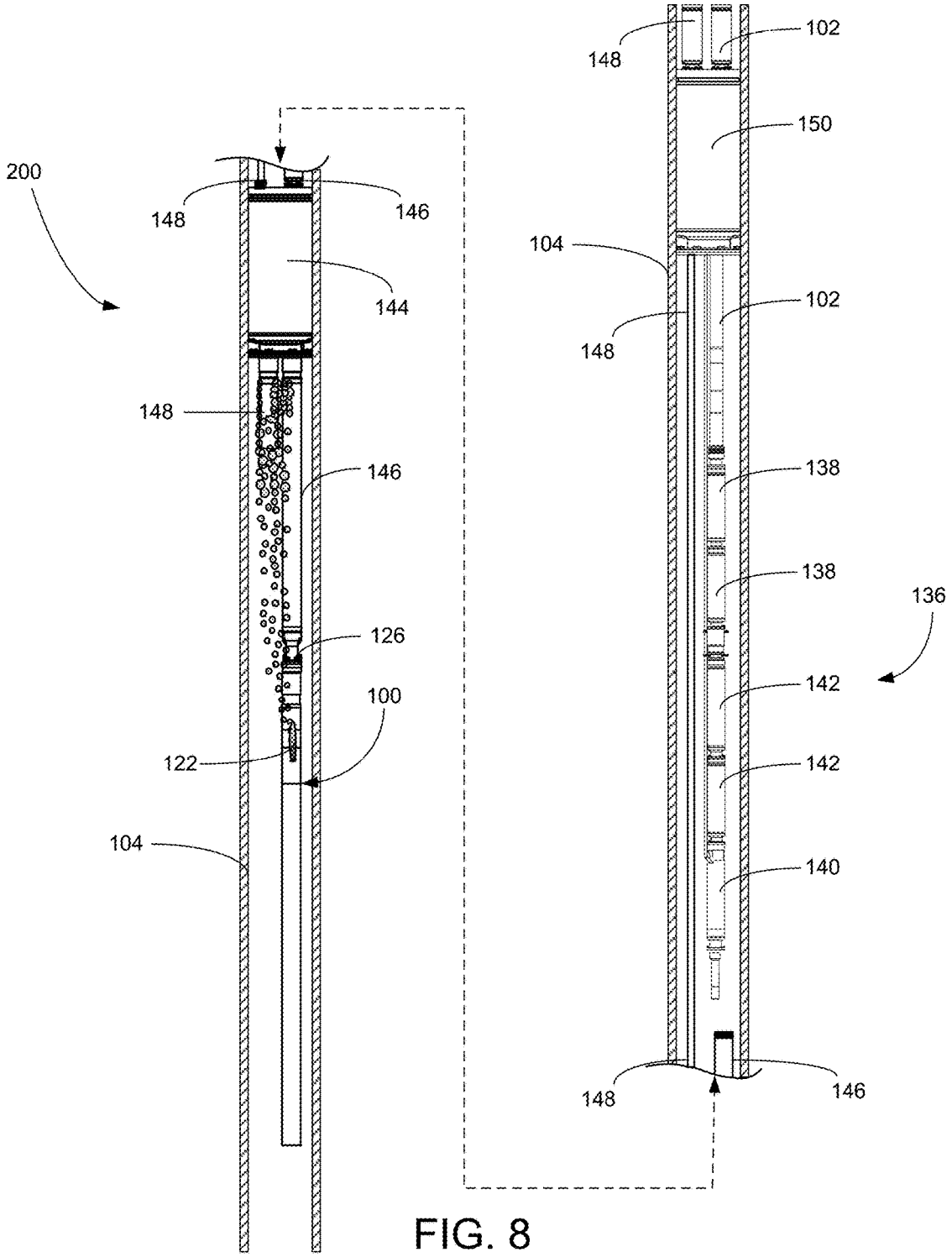
FIG. 8 depicts the use of the passive multiphase separator in connection with an electric submersible pump and a pair of dual packers.

Similarly, the hydrocarbon recovery system 200 shown in FIG. 8 also includes the combined use of the passive multiphase separator 100, the lower packer 144 and the pumping system 136. However, in addition to the lower packer 144, the hydrocarbon recovery system 200 further includes an upper packer 150 that is positioned in the wellbore 104 above the pumping system 136. The upper packer 150 generally separates the wellbore 104 into isolated zones above and below the upper packer 150. As shown in FIG. 8, the upper packer 150 is configured as a "dual packer" that accommodates two lines that extend through the upper packer 150 that each convey fluids between the zones above and below the lower packer 150. The production tubing 102 extends from the pump 138 through the upper packer 150 to the surface. The gas collection line 148 extends through the upper packer 150. However, because the upper packer 150 isolates the zone above the upper packer 150 from the pumping system 136, the gas collection line 148 can discharge the gas into the wellbore above the upper packer 150. Alternatively, the gas collection line 148 can extend from the upper packer 150 to the surface. It will be understood that the gas collection line 148, pup joint 146 and production tubing 102 may be of unitary construction or assembled from multiple segments.

Figure 9:
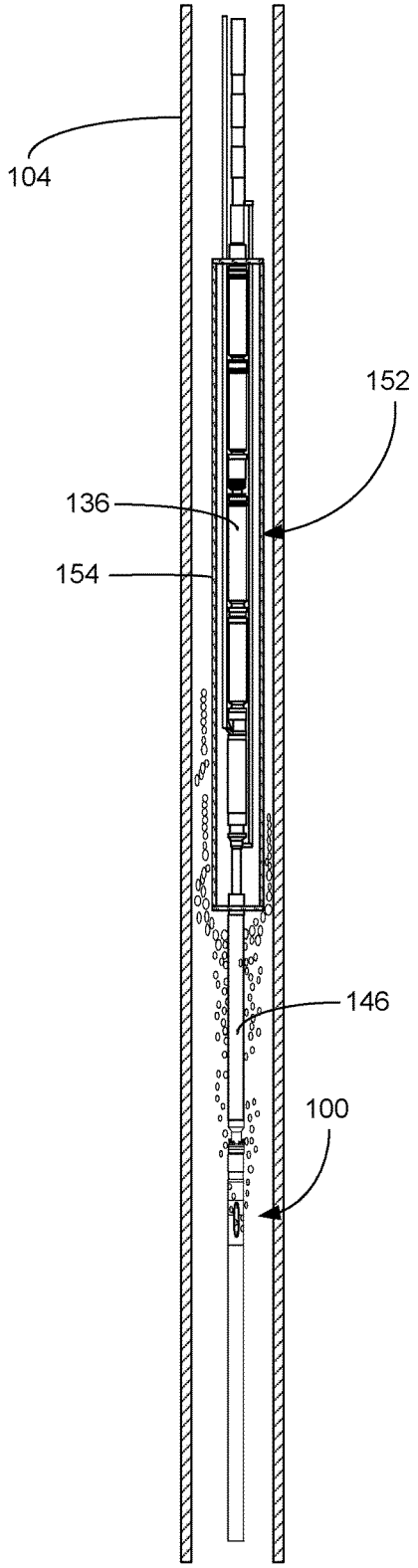
FIG. 9 depicts the use of the passive multiphase separator in connection with an encapsulated electric submersible pump.

Turning to FIG. 9, shown therein is another application of the passive multiphase separator 100 within the hydrocarbon recovery system 200. In this application, the passive multiphase separator 100 is paired with an encapsulated pumping system 152. The encapsulated pumping system 152 includes the pumping system 136 contained within a shroud 154. The shroud 154 isolates the components of the pumping system 136 from the surrounding wellbore 104.

The liquid discharge 126 of the passive multiphase separator 100 is connected in a sealed manner through the lower end of the shroud 154 directly or with an intervening pup joint 146 (as shown in FIG. 9). In this way, liquids expelled from the liquid discharge 126 are directed to the pumping system 136 inside the shroud 154. Gases vented from the passive multiphase separator 100 are prevented from being drawn into the pump 138 by the sealed shroud 154. The liberated gases pass through the annular space between the shroud 154 and the wellbore 104. In this way, the shroud 154 and the passive multiphase separator 100 cooperate to feed the pump 138 with a predominately liquid fluid that reduces the risk of gas locking at the pump 138.

Figure 10:
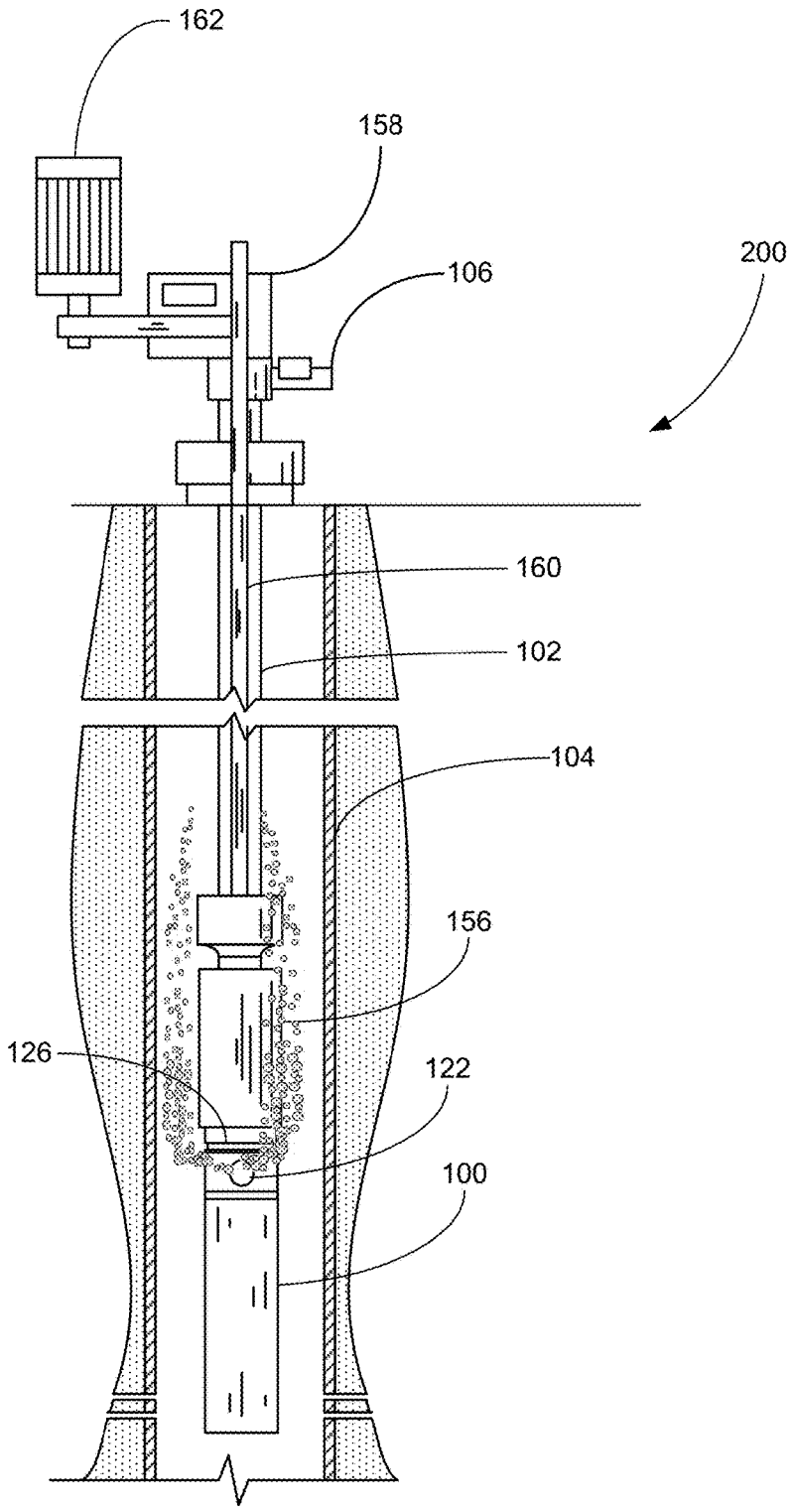
FIG. 10 depicts the use of the passive multiphase separator with a surface-driven, rotary progressing cavity pumping system.

Turning to FIG. 10, shown therein is an additional application of the passive multiphase separator 100 in connection with a progressing cavity pump 156 that is driven by a drive assembly 158. The drive assembly 158 mounted above the wellhead 106 rotates a rod string 160 that extends through the production tubing 102 to rotate the progressing cavity pump 156. The drive assembly 158 is driven by a hydraulic or electric PCP motor 162. The progressing cavity pump 156 may include a rotor and stator that cooperate to produce a series of fixed cavities that effectively move through the pump as 156 the rotor is turned within the stator. Examples of progressing cavity pumps 156 include Moineau-type pumps and screw-type pumps.

The fluid intake of the progressing cavity pump 156 is connected to the liquid discharge 126 of the passive multiphase separator 100. As fluid is drawn by the progressing cavity pump 156 through the passive multiphase separator 100, gases are expelled through the gas vents 122 into the wellbore 104 through the operation of the passive multiphase separator 100, as described above. The remaining predominately liquid stream is passed into the progressing cavity pump 156, where is forced through the production tubing 102 to the wellhead 106.

In another aspect, a method of using the hydrocarbon recovery system 200 and passive multiphase separator 100 to remove gas from a multiphase fluid without the use of motorized agitation or separation includes the steps of connecting the passive multiphase separator 100 to production tubing 102, and deploying the passive multiphase separator 100 and production tubing 102 into the wellbore 104. The method also includes the steps of allowing a multiphase fluid to be moved through the passive multiphase separator 100, separating gas from liquid in the multiphase fluid within the passive multiphase separator 100, diverting gaseous components into the wellbore 104 and directing liquid components to the surface through the production tubing 102.

In other embodiments, the method includes the step of deploying the passive multiphase separator 100 into the wellbore 104 through the production tubing 102. In these embodiments, the method may include the step of landing the passive multiphase separator 100 within the production tubing 102 adjacent the Y-tool 132 such that the gas expelled by the passive multiphase separator 100 can be captured by the Y-tool 132 and either discharged into the wellbore or directed to the surface through the gas bypass line 134.

In yet other embodiments, the method of separating gas from a multiphase fluid using the passive multiphase separator 100 includes the steps of deploying the passive multiphase separator 100 in combination with a downhole pumping system 136 or progressing cavity pump 156. In these embodiments, the methods include the use of the pumping system 136, progressing cavity pump 156 or other artificial lift mechanism to force a multiphase fluid through the passive multiphase separator 100. The method includes the step of separating gas from liquid in the rifled interior section 118 of the passive multiphase separator 100. The method continues with the steps of discharging the separated gas into the wellbore 104 or conveying the gas to the surface through a dedicated gas bypass line 134. It will be appreciated that these methods may further include the use of the lower packer 144, the upper packer 150 and the shroud 154.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A passive multiphase separator configured to separate gas from a two-phase fluid in a wellbore, the passive multiphase separator comprising:
- an intake tube, wherein the intake tube comprises:
  - an intake end;
  - a discharge end; and
  - an interior section between the intake end and the discharge end, wherein the interior section includes a rifled interior surface; and
- a head assembly connected to the discharge end of the intake tube, wherein the head assembly comprises:
  - a crossover tube extending into the interior section;
  - one or more gas vents extending from an interior of the crossover tube to an exterior of the head assembly; and
  - a liquid discharge.

2. The passive multiphase separator of claim 1, wherein the crossover tube comprises an open lower end and a capped upper end.

3. The passive multiphase separator of claim 1, further comprising one or more stabilization fins that are each connected to a corresponding one of the one or more gas vents.

4. A hydrocarbon recovery system for use in conveying multiphase hydrocarbons from a wellbore to a wellhead, the hydrocarbon recovery system comprising:
- production tubing connected to the wellhead and extending into the wellbore; and
- a passive multiphase separator connected to the production tubing, wherein the passive multiphase separator comprises:
  - an intake tube, wherein the intake tube comprises:
    - an intake end;
    - a discharge end; and
    - an interior section between the intake end and the discharge end, wherein the interior section includes a rifled interior surface; and
  - a head assembly connected to the discharge end of the intake tube, wherein the head assembly comprises:
    - a crossover tube extending into the interior section;
    - one or more gas vents extending from an interior of the crossover tube to an exterior of the head assembly; and
    - a liquid discharge.

5. The hydrocarbon recovery system of claim 4, wherein the crossover tube comprises an open lower end and a capped upper end.

6. The hydrocarbon recovery system of claim 5, wherein the head assembly further comprising one or more stabilization fins that are each connected to a corresponding one of the one or more gas vents.

7. The hydrocarbon recovery system of claim 4 further comprising:
- a Y-tool connected to the head assembly of the passive multiphase separator; and
- a gas bypass line connected to the Y-tool.

8. The hydrocarbon recovery system of claim 7 further comprising a gas bypass line connected between the wellhead and the Y-tool to convey gas expelled from the passive multiphase separator to the wellhead.

9. The hydrocarbon recovery system of claim 4 further comprising a pumping system, wherein the pumping system comprises:
- an electric motor; and
- a pump driven by the electric motor, wherein the pump is in fluid communication with the liquid discharge of the passive multiphase separator.

10. The hydrocarbon recovery system of claim 9 further comprising a lower packer, wherein the lower packer is located in the wellbore below the pumping system and wherein the passive multiphase separator is located below the lower packer.

11. The hydrocarbon recovery system of claim 10 further comprising a pup joint extending from the liquid discharge of the passive multiphase separator through the lower packer.

12. The hydrocarbon recovery system of claim 11 further comprising a gas collection line that extends from below the lower packer to the surface to prevent collected gas from entering the pump.

13. The hydrocarbon recovery system of claim 12 further comprising an upper packer positioned in the wellbore above the pumping system.

14. The hydrocarbon recovery system of claim 9 further comprising a shroud that encapsulates the pumping system and wherein the liquid discharge of the passive multiphase separator extends into the shroud.

15. The hydrocarbon recovery system of claim 4 further comprising:
- a downhole progressing cavity pump connected to the liquid discharge of the passive multiphase separator;
- a drive assembly positioned above the wellhead; and
- a rod string extending from the drive assembly to the progressing cavity pump, wherein the drive assembly rotates the rod string to operate the progressing cavity pump.

16. A hydrocarbon recovery system for use in conveying multiphase hydrocarbons from a wellbore to a wellhead, the hydrocarbon recovery system comprising:

production tubing connected to the wellhead and extending into the wellbore; and a passive multiphase separator deployed through the production tubing and retained within the production tubing, wherein the passive multiphase separator comprises:

an intake tube, wherein the intake tube comprises:

an intake end;

a discharge end; and an interior section between the intake end and the discharge end, wherein the interior section includes a rifled interior surface; and a head assembly connected to the discharge end of the intake tube, wherein the head assembly comprises:

a crossover tube extending into the interior section;

one or more gas vents connected to the crossover tube; and a liquid discharge in fluid communication with an interior of the production tubing.

17. The hydrocarbon recovery system of claim 16 further comprising a Y-tool connected to the production tubing, wherein the Y-tool is connected adjacent to the one or more gas vents of the head assembly and wherein the gas expelled from the one or more gas vents is captured within the Y-tool.

18. The hydrocarbon recovery system of claim 17 further comprising a gas bypass line connected between the Y-tool and the wellhead.

19. The hydrocarbon recovery system of claim 16, wherein the crossover tube comprises an open lower end and a capped upper end.

20. The hydrocarbon recovery system of claim 16, wherein the head assembly further comprising one or more stabilization fins that are each connected to a corresponding one of the one or more gas vents.

* * * * *